US007160584B2

(12) United States Patent
Goeb et al.

(10) Patent No.: US 7,160,584 B2
(45) Date of Patent: Jan. 9, 2007

(54) METHOD FOR MANUFACTURING CERAMIC GLOW PLUGS

(75) Inventors: Oliver Goeb, Marbach (DE); Hans Houben, Wuerselen (DE); Lutz Frassek, Roedental (DE); Henning Von Watzdorf, Ludwigsburg (DE); Martin Allgaier, Ludwigsburg (DE); Johann Weissenbacher, Obersulm-Sulzbach (DE)

(73) Assignee: Beru AG, Ludwigsburg (DE)

( * ) Notice: Subject to any disclaimer, the term of this patent is extended or adjusted under 35 U.S.C. 154(b) by 0 days.

(21) Appl. No.: 10/984,881

(22) Filed: Nov. 10, 2004

(65) Prior Publication Data

US 2005/0145613 A1 Jul. 7, 2005

(30) Foreign Application Priority Data

Nov. 19, 2003 (DE) ..... 103 53 972

(51) Int. Cl.
*B05D 5/00* (2006.01)
*C23C 4/14* (2006.01)
*B29C 47/06* (2006.01)

(52) U.S. Cl. ..... 427/454; 427/450; 427/452; 427/126.2; 427/289; 427/293; 427/356; 427/376.1; 427/376.2; 427/419.1; 427/419.3; 427/419.7; 427/427; 264/603; 264/618; 264/211.11; 264/173.12; 264/173.16

(58) Field of Classification Search ..... 427/450
See application file for complete search history.

(56) References Cited

U.S. PATENT DOCUMENTS

| | | | | |
|---|---|---|---|---|
| 4,418,661 | A * | 12/1983 | Esper et al. | 123/145 A |
| 4,742,209 | A | 5/1988 | Minegishi et al. | |
| 5,338,716 | A * | 8/1994 | Triplett et al. | 502/64 |
| 6,084,212 | A | 7/2000 | Leigh | |
| 6,184,497 | B1 | 2/2001 | Leigh | |
| 6,309,589 | B1 | 10/2001 | Knoll et al. | |
| 6,396,028 | B1 * | 5/2002 | Radmacher | 219/270 |
| 6,621,196 | B1 | 9/2003 | Geissinger et al. | |
| 6,710,305 | B1 | 3/2004 | Lindemann et al. | |

FOREIGN PATENT DOCUMENTS

| | | | |
|---|---|---|---|
| DE | 101 55 2003 | | 6/2003 |
| EP | 0 601 727 | | 6/1994 |
| JP | 09-159170 | * | 6/1997 |

* cited by examiner

*Primary Examiner*—Katherine Bareford
(74) *Attorney, Agent, or Firm*—David S. Safran

(57) ABSTRACT

A method for manufacturing a ceramic glow pin which is formed of more than two layers arranged especially coaxially to the axis of the glow pin and symmetrically. The layers of the layer structure are manufactured by co-extrusion.

14 Claims, 5 Drawing Sheets

METHOD FOR MANUFACTURING CERAMIC GLOW PLUGS

BACKGROUND OF THE INVENTION

1. Field of Invention

The invention relates to a method for manufacturing a ceramic glow pin which has more than two layers.

2. Description of Related Art

Ceramic glow pins, which are used, ready-manufactured, as glow plugs in the area of internal combustion engines, are characterised in that they can be heated up more quickly than the steel glow plugs used hitherto and have a far longer life.

Already known from U.S. Pat. No. 6,309,589 and German Patent Application DE 100 53 327 A1 (corresponding to U.S. Pat. No. 6,710,305), are ceramic glow pins with planar structures which are designed from manufacturing points of view, so that a homogeneous temperature distribution required for optimum combustion is not ensured.

Furthermore, known from U.S. Pat. No. 6,184,497 B1, EP 0 601 727 B1, U.S. Pat. No. 6,084,212 A, German Patent DE 36 21 216 C1 (corresponding to U.S. Pat. No. 4,742,209), DE 198 44 347 A1 (corresponding to U.S. Pat. No. 6,621,196) and German Patent DE 101 55 203 C1 are designs and methods of manufacture for ceramic glow pins in which layer structures are provided which can only be manufactured by slip casting methods which are difficult to automate in the given layer thickness or are structures which can only be implemented by expensive methods of manufacture which are thus associated with high costs, such as screen printing on laminates followed by hot pressing, for example. These designs and methods of manufacture are difficult to implement on an industrial scale and do not meet the demand of the car industry for inexpensive components.

SUMMARY OF THE INVENTION

The object forming the basis of the present invention is thus to provide a method of the type specified initially which is cheap and suitable for series production.

This object is solved according to the invention by the ceramic glow pin being formed of more than two layers, in which the layers of the layer structure are formed by co-extrusion.

By using co-extrusion, the layer structure desired for the optimal function of the glow pin can be formed in a simple fashion, namely by simultaneous extrusion of a plurality of layers in the form of a tube or a rod.

Thus, in the method according to the invention a plurality of layers of the ceramic glow pin are produced simultaneously so that only the layer required at one end for the diversion of the electrical current still needs to be provided.

In the method according to the invention, a raw cylinder of the ceramic glow pin especially manufactured by co-extrusion, that is by simultaneous extrusion of all the required layers, is tapered at one end, after calibrating the diameter and cutting the blank to length, by machining methods and is provided at the other end with a contact hole.

The cylinder processed, in this way, is then subjected to binder removal and is pre-sintered in order to achieve sufficient strength for the following process steps.

The above-mentioned tapering of the raw cylinder at one end and the construction of the contact hole at the other end can take place by white treatment using diamond tools also after the binder removal and pre-sintering.

The current-diverting layer or the actual heating layer is then applied by spraying on a slip or by a dipping method wherein this process can also take place after the sintering by thermal spraying.

After drying has been carried out, the green body is fired and ground to its final geometry by a simple and cheap push-through grinding method.

By spraying over or spraying around an insert part, or injection into a tubular insert part, an additionally conducting or non-conducting layer can be applied, which protects the actual heating layer from corrosion or even acts as a heating layer and current-diverting layer itself, or the layer structure can be completed.

Especially preferred exemplary embodiments of the invention are explained in detail subsequently with reference to the accompanying drawings.

DETAILED DESCRIPTION OF THE INVENTION

Figure 1A:
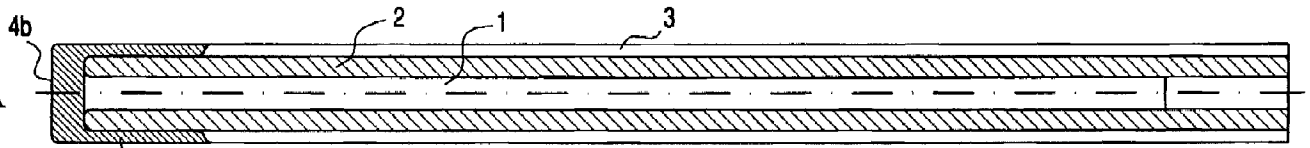
FIGS. 1A to 1D show sectional views of exemplary embodiments of the glow pin which can be manufactured by the method according to the invention in various geometries.

As shown in FIG. 1A, a glow pin for a ceramic glow plug comprises a rotationally symmetrical structure having an electrically conducting inner cylinder 1, an insulating layer 2 provided coaxially around the inner cylinder 1 on its cylindrical outer surface, a conductive layer 3 provided coaxially around insulating layer 2, and the actual heating layer 4 which is constructed as a coaxial layer 4*a* and as a layer 4*b* running perpendicular to the glow pin axis at the end of the arrangement of the inner cylinder 1 and layers 2, 3. However, arrangements of layers which are not rotationally symmetrical and not coaxial to the axis of the glow pin are also possible. For example, the cross sections can be asymmetric, square or rectangular.

Figure 2:
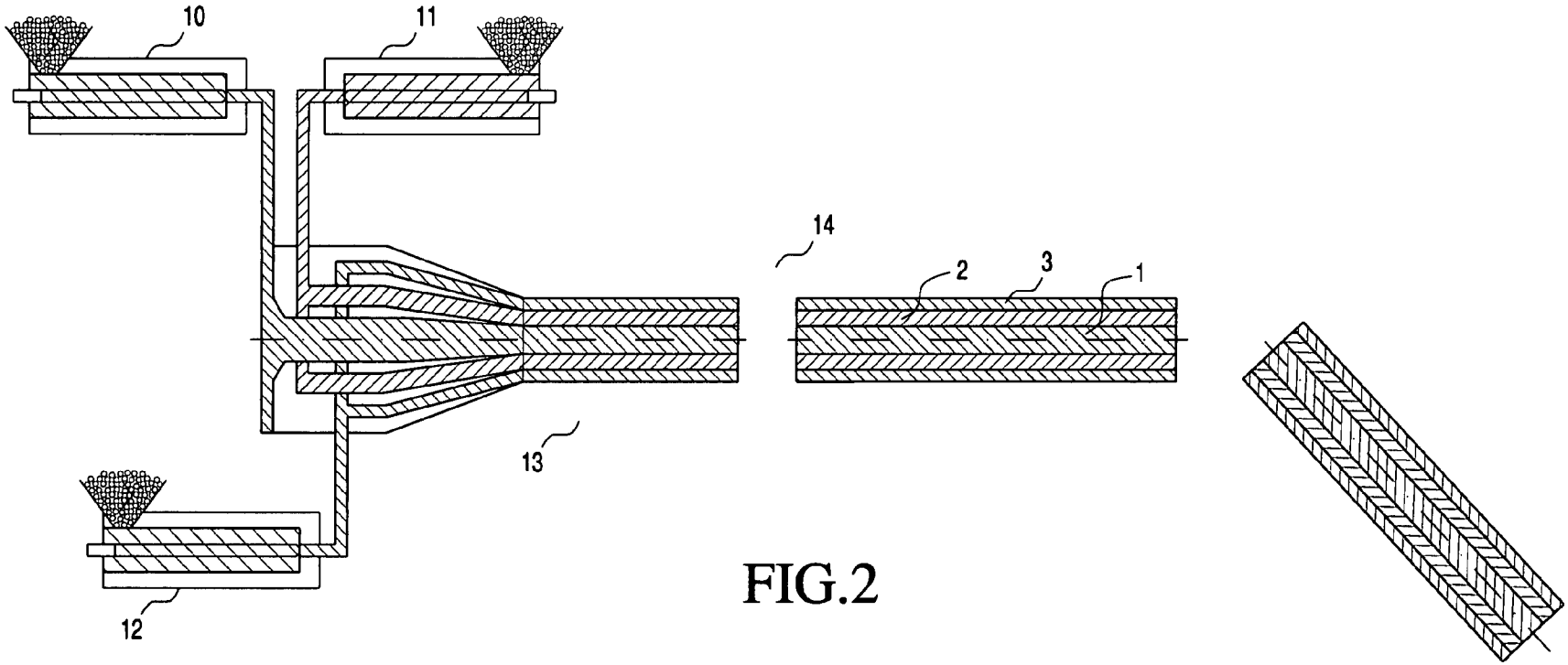
FIG. 2 shows the process step of co-extrusion of a solid glow pin in a sectional view.

FIG. 2 shows the principle of co-extrusion used to manufacture a glow pin according to FIG. 1A. The layer structure is formed by extruders 10, 11 and 12 in a co-extrusion head 13. The extruder 10 produces a conductive core 1, the extruder 11 applies the insulating layer 2, and with the extruder 12, the layer structure is completed with the outer conductive layer 3. The extrusion head 13, to construct three layers can, for example, comprise a tool with spindle sleeve and spiral-mandrel distributors used in plastics technology.

Figure 3:
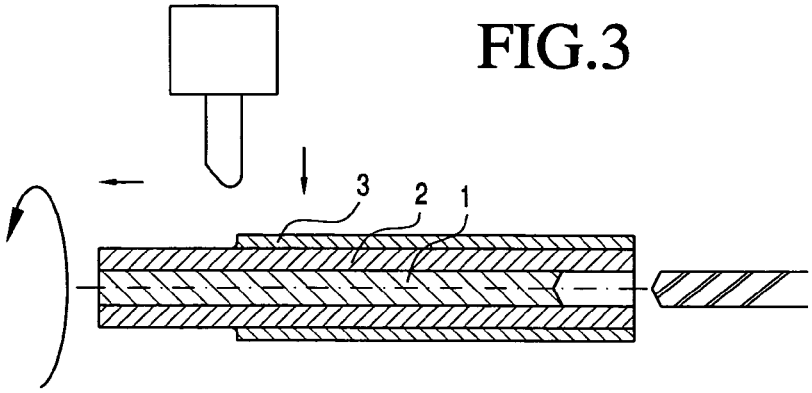
FIG. 3 shows the process step of green or white treatment in a sectional view.
Figure 4:
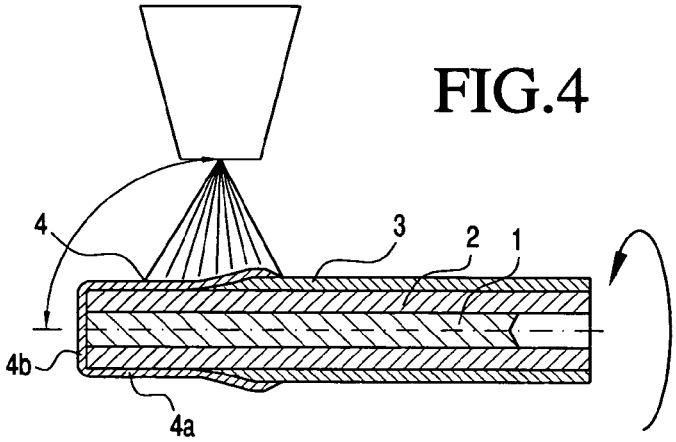
FIG. 4 shows the process step of spraying an additional outer layer in a sectional view.
Figure 5:
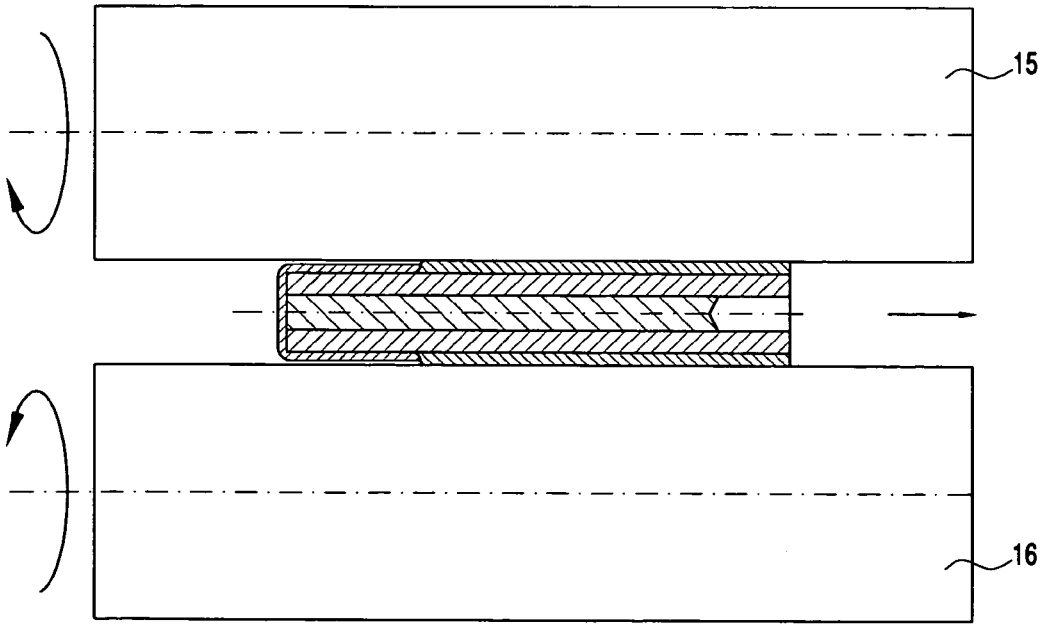
FIG. 5 shows the process step of final processing of the glow pin in a sectional view.

Starting from a three-layer co-extrudate produced in this way with an inner insulator sleeve which is shown hatched, the structure shown in FIG. 1A is produced using the process steps shown in FIGS. 3, 4 and 5.

This means that, after cutting the co-extrudate to length by means of a separating unit 14 and calibrating the diameter, the raw cylinder is tapered at one end and is provided with a contact hole at the other end, as shown schematically in FIG. 3. Before firing, the extruded layer structure is subject to machining or water jet cutting.

The raw cylinder processed according to FIG. 3 is then subjected to binder removal and pre-sintered to give it a sufficient strength for the following work processes.

As shown in FIG. 4, the outer heating and diverting layer 4 is then applied which can be accomplished by spraying on a slip before the sintering but also by dipping, overspraying, thermal spraying, metallizing or pressing on. For this purpose, however, the welding methods conventional in the field of plastics technology, e.g., ultrasound, friction welding methods among others can also be used.

This layer 4 is constructed as coaxial layers 4*a* and 4*b* running perpendicular to the glow pin at the end of the arrangement and makes the connection between the inner and outer conductors.

Figure 1B:
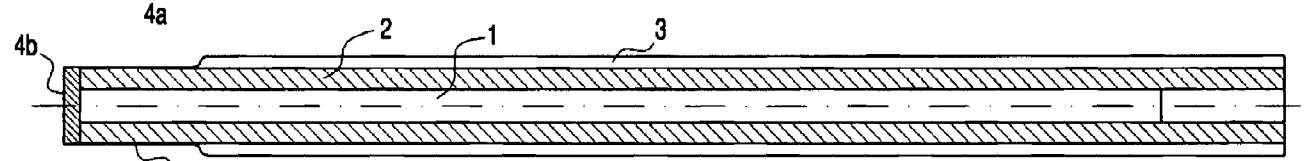

In the exemplary embodiment shown in FIG. 1B and in detail in FIG. 1D, again starting from a three-layer co-extrudate with inner insulator sleeve shown hatched, a structure shown by the process steps in FIGS. 3 and 4 is produced in which the actual heating layer on the outer casing is only formed by a narrowing of the cross-section. FIG. 1D shows the glow zone and the contact zone from top to bottom.

The layer required to divert the electric current on the front face can again be formed by spraying on a slip before the sintering or by dipping, overspraying or thermal spraying. For this purpose, however, the welding methods conventional in the field of plastics technology, e.g., ultrasound, friction welding methods among others can also be used.

Figure 1C:
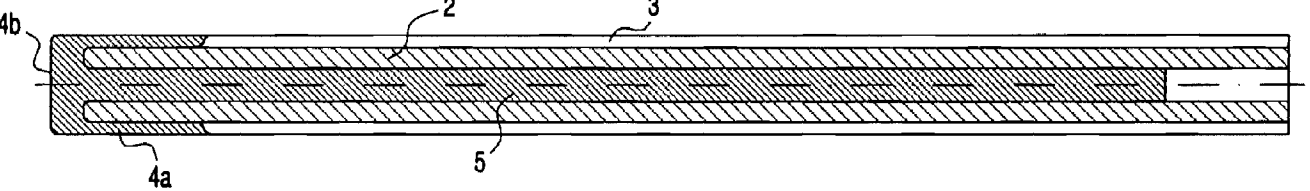
Figure 1D:
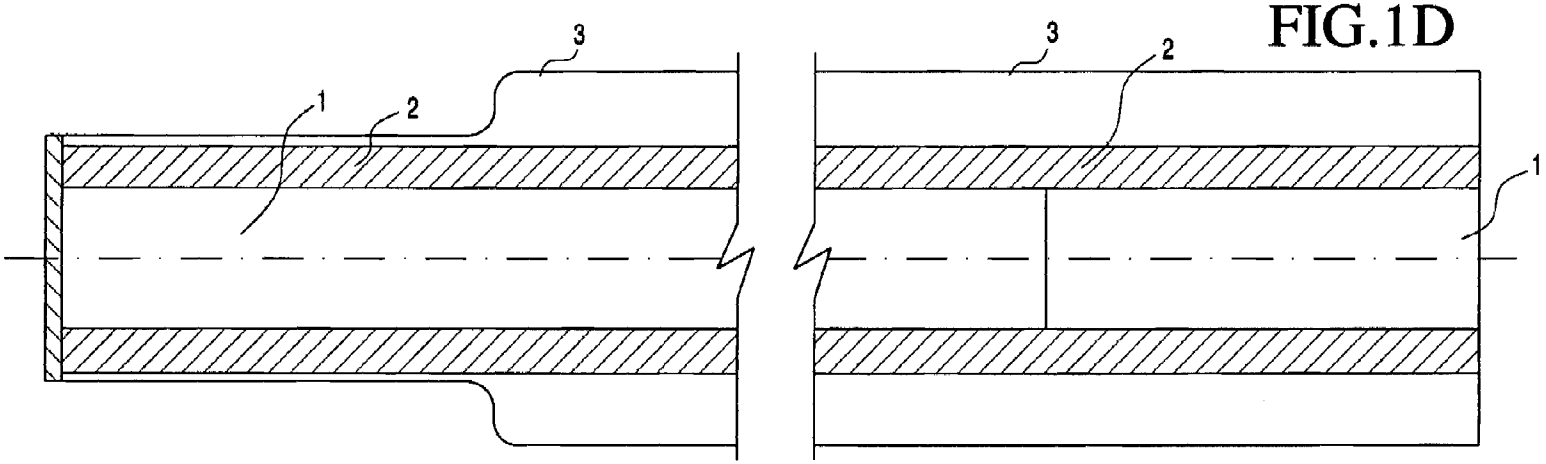
Figure 6:
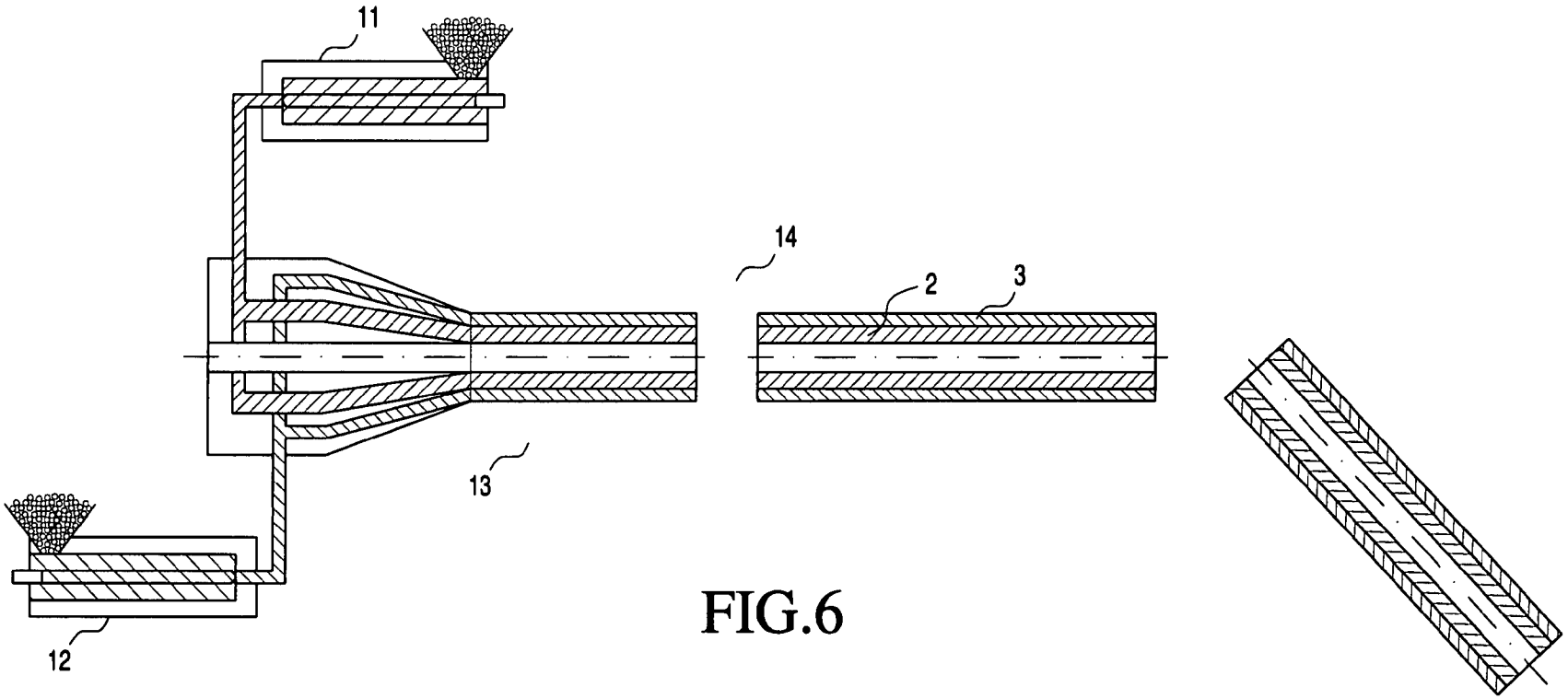
FIG. 6 shows the process step of co-extrusion of a tubular glow pin in a sectional view and FIG. 7 shows the process step of spraying over or injection into the tubular semi-finished product from FIG. 6 in a sectional view.
Figure 7:
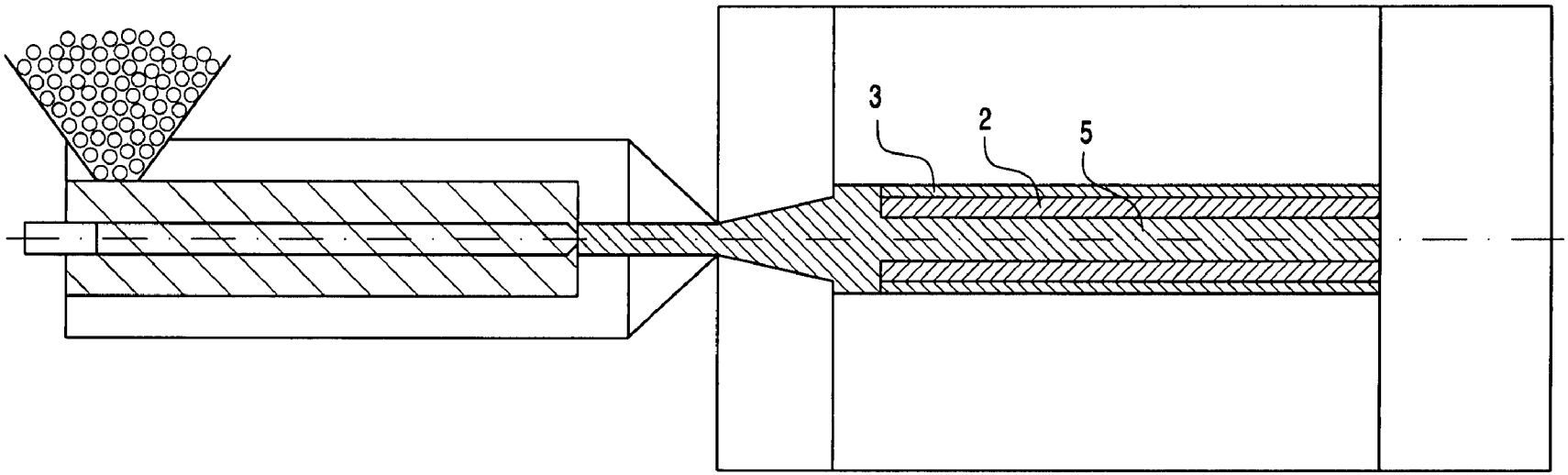

In the exemplary embodiment shown in FIG. 1C, starting from a co-extruded, two-layer tube with an inner insulator layer formed using the co-extrusion shown in FIG. 6, the complete structure with core 5 required for the function of the glow pin is formed by combined injection and over spraying according to FIG. 7 in a conventional injection-molding machine. By using identical feedstocks for the extrusion and the following injection molding, a connection is provided between the layers and the following process steps, for example, binder removal, pre-sintering and sintering can be carried out without any problems.

The method according to the invention can be carried out in a plurality of different variations so that it can be applied to different layer thicknesses and layer types without any problems.

According to FIG. 5, all the exemplary embodiments described above are followed by sintering and a cheap hard treatment in order to ensure the necessary tolerances for the insertion of the ceramic glow pin. After sintering, at least partial polishing of the layer structure can be provided.

This can be accomplished, in accordance with FIG. 5, by a simple and cheap push-through grinding method using a contact roller 15 and grinding wheel 16.

What is claimed is:

1. A method for manufacturing a ceramic glow pin having an inner cylinder and a layer structure formed of at least two layers, comprising simultaneously co-extruding the inner cylinder and the layers of the layer structure.

2. The method according to claim 1, wherein the layers are formed symmetrically to the axis of the glow pin.

3. The method according to claim 2, wherein the layers are constructed coaxially.

4. The method according to claim 1, wherein the layer structure is rotationally symmetrical.

5. The method according to claim 1, wherein at least one of a conductive layer used to divert electric current and a layer lying perpendicular to the glow pin axis is formed at an end of the extruded layer structure by a step selected from the group consisting of spraying-on, metallizing, pressing-on, dipping, and welding.

6. The method according to claim 5, wherein a part of an outer surface is formed by a step selected from the group consisting of spraying-on, metallizing, pressing-on, dipping, and welding.

7. The method according to claim 1, wherein the extruded layer structure, in an unfired state is subject to one of a machining treatment and water-jet cutting.

8. The method according to claim 1, wherein the extruded layer structure is subjected to application of a further layer by one of spraying or injection molding.

9. The method according to claim 1, wherein a conductive layer used to divert electric current is formed as at least one of an end of the extruded layer structure and a layer lying perpendicular to a center axis of the glow pin axis, said conductive layer being formed after sintering of the extruded layer structure by thermal spraying.

10. The method according to claim 9, wherein a part of an outer surface is formed by one of thermal spraying and welding.

11. The method according to claim 1, wherein the layer structure is sintered and then at least partially polished.

12. The method according to claim 1, wherein the inner cylinder and an outer of the two layers of the layer structure are formed using an electrically conducting material and an inner of the two layers of the layer structure is formed using an electrically insulating material.

13. The method according to claim 1, comprising the further step of cutting the co-extrudate to length.

14. The method according to claim 13, wherein an exposed end of the co-extruded inner cylinder and layer structure is covered by a subsequently applied an outer heating and diverting layer which extends, at least in part, in a direction perpendicular to a longitudinal axis of the co-extrudate.

* * * * *